US010553945B2

(12) United States Patent
Yong et al.

(10) Patent No.: US 10,553,945 B2
(45) Date of Patent: Feb. 4, 2020

(54) ANTENNA ARRAYS HAVING SURFACE WAVE INTERFERENCE MITIGATION STRUCTURES

(71) Applicant: Apple Inc., Cupertino, CA (US)

(72) Inventors: Siwen Yong, San Francisco, CA (US); Yi Jiang, Cupertino, CA (US); Jiangfeng Wu, San Jose, CA (US); Lijun Zhang, San Jose, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 343 days.

(21) Appl. No.: 15/710,361

(22) Filed: Sep. 20, 2017

(65) Prior Publication Data

US 2019/0089053 A1 Mar. 21, 2019

(51) Int. Cl.

| | |
|---|---|
| ***H01Q 3/34*** | (2006.01) |
| ***H01Q 21/06*** | (2006.01) |
| ***H01Q 1/24*** | (2006.01) |
| ***H01Q 3/26*** | (2006.01) |
| ***H01Q 1/38*** | (2006.01) |
| ***H01Q 1/22*** | (2006.01) |
| ***H01Q 1/42*** | (2006.01) |

(52) U.S. Cl.

CPC ..... *H01Q 3/34* (2013.01); *H01Q 1/2266* (2013.01); *H01Q 1/243* (2013.01); *H01Q 1/38* (2013.01); *H01Q 1/42* (2013.01); *H01Q 3/26* (2013.01); *H01Q 21/065* (2013.01)

(58) Field of Classification Search

CPC ..... H01Q 3/34; H01Q 1/243; H01Q 21/065; H01Q 1/38; H01Q 1/2283; H01Q 9/0407; H01Q 1/523; H01Q 21/24; H01Q 1/242

See application file for complete search history.

(56) References Cited

U.S. PATENT DOCUMENTS

| | | | | |
|---|---|---|---|---|
| 8,378,893 | B2 * | 2/2013 | Harokopus | H01Q 1/523 343/700 MS |
| 9,667,290 | B2 | 5/2017 | Ouyang et al. | |
| 2017/0133756 | A1 | 5/2017 | Eastburg et al. | |
| 2017/0201014 | A1 * | 7/2017 | Lee | H01Q 1/243 |
| 2017/0237148 | A1 | 8/2017 | Patel et al. | |

(Continued)

*Primary Examiner* — Dameon E Levi
*Assistant Examiner* — David E Lotter
(74) *Attorney, Agent, or Firm* — Treyz Law Group, P.C.; Joseph F. Guihan

(57) ABSTRACT

An electronic device may be provided with wireless communications circuitry and control circuitry. The wireless communications circuitry may include centimeter and millimeter wave transceiver circuitry and a phased antenna array. A dielectric cover may be formed over the phased antenna array. The phased antenna array may transmit and receive antenna signals through the dielectric cover. The dielectric cover may have a surface that faces the phased antenna array and may have a curvature. The antenna elements of the phased antenna array may be formed on a dielectric substrate. The dielectric substrate may have one or more thinned regions between antenna elements of the phased antenna array to reduce surface wave interference between adjacent antennas. The dielectric substrate may have a smaller thickness in the thinned region than in the regions under the antenna elements. The dielectric substrate may be totally removed in the thinned region.

20 Claims, 12 Drawing Sheets

(56) References Cited

U.S. PATENT DOCUMENTS

| | | | | |
|---|---|---|---|---|
| 2017/0237171 | A1 | 8/2017 | Kim et al. | |
| 2017/0271772 | A1 | 9/2017 | Miraftab et al. | |
| 2019/0051989 | A1* | 2/2019 | Kim | H01Q 15/08 |

* cited by examiner

ANTENNA ARRAYS HAVING SURFACE WAVE INTERFERENCE MITIGATION STRUCTURES

BACKGROUND

This relates generally to electronic devices and, more particularly, to electronic devices with wireless communications circuitry.

Electronic devices often include wireless communications circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths, but may raise significant challenges. For example, millimeter wave communications signals generated by antennas can be characterized by substantial attenuation and/or distortion during signal propagation through various mediums.

It would therefore be desirable to be able to provide electronic devices with improved wireless communications circuitry such as communications circuitry that supports millimeter wave communications.

SUMMARY

An electronic device may be provided with wireless circuitry. The wireless circuitry may include one or more antennas and transceiver circuitry such as centimeter and millimeter wave transceiver circuitry (e.g., circuitry that transmits and receives antennas signals at frequencies greater than 10 GHz). The antenna elements may be arranged in a phased antenna array.

A dielectric cover (sometimes referred to herein as a radome) may be formed over the antenna elements in the phased antenna array. The phased antenna array may transmit and receive a beam of signals through the dielectric cover and may steer the signals over a corresponding field of view. The dielectric cover may have a first surface and a second opposing surface that faces the phased antenna array. The second surface may be a curved surface (e.g., may include a curve).

The antenna elements of the phased antenna array may be formed on a dielectric substrate. The dielectric substrate may have one or more thinned regions between antenna elements of the phased antenna array to reduce surface wave interference between adjacent antennas in the phased antenna array. The thinned regions may include a notch in the dielectric substrate such that the dielectric substrate has a smaller thickness between antenna elements than under the antenna elements. The dielectric substrate may be totally removed in the thinned region.

A ground layer may be coupled to the dielectric substrate. The ground layer may be planar or may be bent (e.g., bent at the thinned portions of the dielectric substrate). The phased antenna array may also include transmission line structures. Each transmission line structure may be coupled to a respective antenna element of the phased antenna array through the dielectric substrate.

DETAILED DESCRIPTION

Electronic devices may contain wireless circuitry. The wireless circuitry may include one or more antennas. The antennas may include phased antenna arrays that are used for handling millimeter wave and centimeter wave communications. Millimeter wave communications, which are sometimes referred to as extremely high frequency (EHF) communications, involve signals at 60 GHz or other frequencies between about 30 GHz and 300 GHz. Centimeter wave communications involve signals at frequencies between about 10 GHz and 30 GHz. While uses of millimeter wave communications may be described herein as examples, centimeter wave communications, EHF communications, or any other types of communications may be similarly used. If desired, electronic devices may also contain wireless communications circuitry for handling satellite navigation system signals, cellular telephone signals, local wireless area network signals, near-field communications, light-based wireless communications, or other wireless communications.

Electronic devices (such as device 10 in FIG. 1) may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a virtual or augmented reality headset device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, a wireless access point or base station (e.g., a wireless router or other equipment for routing communications between other wireless devices and a larger network such as the internet or a cellular telephone network), a desktop computer, a keyboard, a gaming controller, a computer mouse, a mousepad, a trackpad or touchpad, equipment that implements the functionality of two or more of these devices, or other electronic equipment. The above-mentioned examples are merely illustrative. Other configurations may be used for electronic devices if desired.

Figure 1:
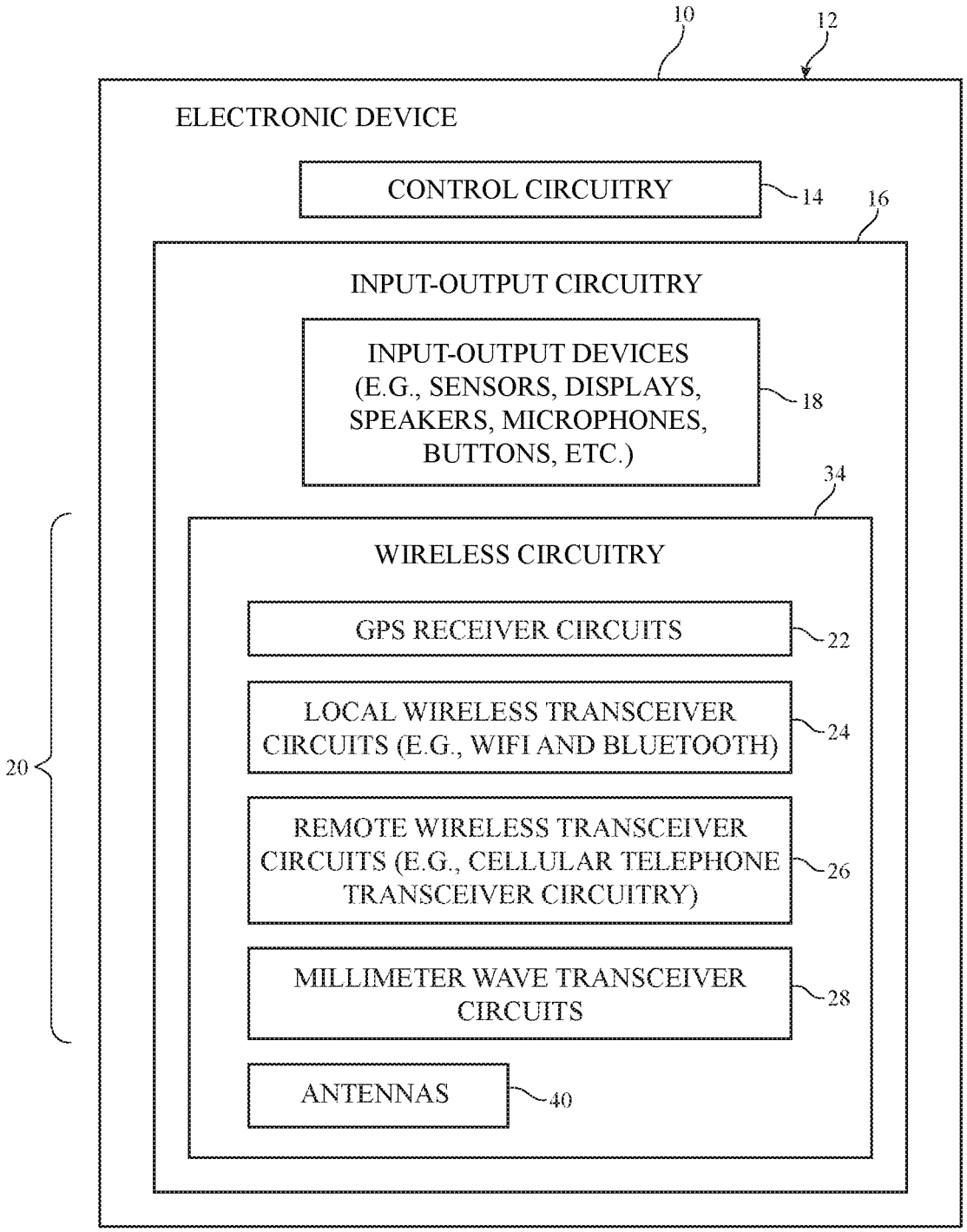
FIG. 1 is a schematic diagram of an illustrative electronic device with wireless communications circuitry in accordance with an embodiment.

A schematic diagram showing illustrative components that may be used in an electronic device such as electronic device 10 is shown in FIG. 1. As shown in FIG. 1, device 10 may include storage and processing circuitry such as control circuitry 14. Control circuitry 14 may include storage such as hard disk drive storage, nonvolatile memory (e.g., flash memory or other electrically-programmable-read-only memory configured to form a solid-state drive), volatile memory (e.g., static or dynamic random-access-memory), etc. Processing circuitry in control circuitry 14 may be used to control the operation of device 10. This processing circuitry may be based on one or more microprocessors, microcontrollers, digital signal processors, baseband processor integrated circuits, application specific integrated circuits, etc.

Control circuitry 14 may be used to run software on device 10, such as internet browsing applications, voice-over-internet-protocol (VOIP) telephone call applications, email applications, media playback applications, operating system functions, etc. To support interactions with external equipment, control circuitry 14 may be used in implementing communications protocols. Communications protocols that may be implemented using control circuitry 14 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, etc.

Device 10 may include input-output circuitry 16. Input-output circuitry 16 may include input-output devices 18. Input-output devices 18 may be used to allow data to be supplied to device 10 and to allow data to be provided from device 10 to external devices. Input-output devices 18 may include user interface devices, data port devices, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 16 may include wireless communications circuitry 34 for communicating wirelessly with external equipment. Wireless communications circuitry 34 may include radio-frequency (RF) transceiver circuitry formed from one or more integrated circuits, power amplifier circuitry, low-noise input amplifiers, passive RF components, one or more antennas 40, transmission lines, and other circuitry for handling RF wireless signals. Wireless signals can also be sent using light (e.g., using infrared communications).

Wireless communications circuitry 34 may include transceiver circuitry 20 for handling various radio-frequency communications bands. For example, circuitry 34 may include transceiver circuitry 22, 24, 26, and 28.

Transceiver circuitry 24 may be wireless local area network transceiver circuitry. Transceiver circuitry 24 may handle 2.4 GHz and 5 GHz bands for WiFi® (IEEE 802.11) communications and may handle the 2.4 GHz Bluetooth® communications band.

Circuitry 34 may use cellular telephone transceiver circuitry 26 for handling wireless communications in frequency ranges such as a low communications band from 700 to 960 MHz, a midband from 1710 to 2170 MHz, a high band from 2300 to 2700 MHz, a ultra-high band from 3400 to 3700 MHz, or other communications bands between 600 MHz and 4000 MHz or other suitable frequencies (as examples). Circuitry 26 may handle voice data and non-voice data.

Millimeter wave transceiver circuitry 28 (sometimes referred to as extremely high frequency (EHF) transceiver circuitry 28 or transceiver circuitry 28) may support communications at frequencies between about 10 GHz and 300 GHz. For example, transceiver circuitry 28 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, transceiver circuitry 28 may support communications in an IEEE K communications band between about 18 GHz and 27 GHz, a $K_a$ communications band between about 26.5 GHz and 40 GHz, a Ku communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, circuitry 28 may support IEEE 802.11ad communications at 60 GHz and/or 5th generation mobile networks or 5th generation wireless systems (5G) communications bands between 27 GHz and 90 GHz. If desired, circuitry 28 may support communications at multiple frequency bands between 10 GHz and 300 GHz such as a first band from 27.5 GHz to 28.5 GHz, a second band from 37 GHz to 41 GHz, and a third band from 57 GHz to 71 GHz, or other communications bands between 10 GHz and 300 GHz. Circuitry 28 may be formed from one or more integrated circuits (e.g., multiple integrated circuits mounted on a common printed circuit in a system-in-package device, one or more integrated circuits mounted on different substrates, etc.). While circuitry 28 is sometimes referred to herein as millimeter wave transceiver circuitry 28, millimeter wave transceiver circuitry 28 may handle communications at any desired communications bands at frequencies between 10 GHz and 300 GHz (e.g., in millimeter wave communications bands, centimeter wave communications bands, etc.).

Wireless communications circuitry 34 may include satellite navigation system circuitry such as Global Positioning System (GPS) receiver circuitry 22 for receiving GPS signals at 1575 MHz or for handling other satellite positioning data (e.g., GLONASS signals at 1609 MHz). Satellite navigation system signals for receiver 22 are received from a constellation of satellites orbiting the earth.

In satellite navigation system links, cellular telephone links, and other long-range links, wireless signals are typically used to convey data over thousands of feet or miles. In WiFi® and Bluetooth® links at 2.4 and 5 GHz and other short-range wireless links, wireless signals are typically used to convey data over tens or hundreds of feet. Extremely high frequency (EHF) wireless transceiver circuitry 28 may convey signals that travel (over short distances) between a transmitter and a receiver over a line-of-sight path. To enhance signal reception for millimeter and centimeter wave communications, phased antenna arrays and beam steering techniques may be used (e.g., schemes in which antenna signal phase and/or magnitude for each antenna in an array is adjusted to perform beam steering). Antenna diversity schemes may also be used to ensure that the antennas that have become blocked or that are otherwise degraded due to the operating environment of device 10 can be switched out of use and higher-performing antennas used in their place.

Wireless communications circuitry 34 can include circuitry for other short-range and long-range wireless links if desired. For example, wireless communications circuitry 34 may include circuitry for receiving television and radio signals, paging system transceivers, near field communications (NFC) circuitry, etc.

Antennas 40 in wireless communications circuitry 34 may be formed using any suitable antenna types. For example, antennas 40 may include antennas with resonating elements that are formed from loop antenna structures, patch antenna structures, inverted-F antenna structures, slot antenna structures, planar inverted-F antenna structures, monopoles, dipoles, helical antenna structures, Yagi (Yagi-Uda) antenna structures, hybrids of these designs, etc. If desired, one or more of antennas 40 may be cavity-backed antennas. Different types of antennas may be used for different bands and combinations of bands. For example, one type of antenna may be used in forming a local wireless link antenna and another type of antenna may be used in forming a remote wireless link antenna. Dedicated antennas may be used for receiving satellite navigation system signals or, if desired, antennas 40 can be configured to receive both satellite navigation system signals and signals for other communications bands (e.g., wireless local area network signals and/or cellular telephone signals). Antennas 40 can include phased antenna arrays for handling millimeter wave communications.

As shown in FIG. 1, device 10 may include a housing such as housing 12. Housing 12, which may sometimes be referred to as an enclosure or case, may be formed of plastic, glass, ceramics, fiber composites, metal (e.g., stainless steel, aluminum, metallic coatings on a substrate, etc.), other suitable materials, or a combination of any two or more of these materials. Housing 12 may be formed using a unibody configuration in which some or all of housing 12 is machined or molded as a single structure or may be formed using multiple structures (e.g., an internal frame structure, one or more structures that form exterior housing surfaces, etc.). Antennas 40 may be mounted in housing 12. Dielectric-filled openings such as plastic-filled openings may be formed in metal portions of housing 12 (e.g., to serve as antenna windows and/or to serve as gaps that separate portions of antennas 40 from each other).

In scenarios where input-output devices 18 include a display, the display may be a touch screen display that incorporates a layer of conductive capacitive touch sensor electrodes or other touch sensor components (e.g., resistive touch sensor components, acoustic touch sensor components, force-based touch sensor components, light-based touch sensor components, etc.) or may be a display that is not touch-sensitive. Capacitive touch screen electrodes may be formed from an array of indium tin oxide pads or other transparent conductive structures. The display may include an array of display pixels formed from liquid crystal display (LCD) components, an array of electrophoretic display pixels, an array of plasma display pixels, an array of organic light-emitting diode display pixels, an array of electrowetting display pixels, or display pixels based on other display technologies. The display may be protected using a display cover layer such as a layer of transparent glass, clear plastic, sapphire, or other transparent dielectric. If desired, some of the antennas 40 (e.g., antenna arrays that may implement beam steering, etc.) may be mounted under an inactive border region of the display. The display may contain an active area with an array of pixels (e.g., a central rectangular portion). Inactive areas of the display are free of pixels and may form borders for the active area. If desired, antennas may also operate through dielectric-filled openings elsewhere in device 10.

If desired, housing 12 may include a conductive rear surface. The rear surface of housing 12 may lie in a plane that is parallel to a display of device 10. In configurations for device 10 in which the rear surface of housing 12 is formed from metal, it may be desirable to form parts of peripheral conductive housing structures as integral portions of the housing structures forming the rear surface of housing 12. For example, a rear housing wall of device 10 may be formed from a planar metal structure, and portions of peripheral housing structures on the sides of housing 12 may be formed as vertically extending integral metal portions of the planar metal structure. Housing structures such as these may, if desired, be machined from a block of metal and/or may include multiple metal pieces that are assembled together to form housing 12. The planar rear wall of housing 12 may have one or more, two or more, or three or more portions. The peripheral housing structures and/or the conductive rear wall of housing 12 may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide internal structures from view of the user).

Transmission line paths may be used to route antenna signals within device 10. For example, transmission line paths may be used to couple antenna structures 40 to transceiver circuitry 20. Transmission lines in device 10 may include coaxial cable paths, microstrip transmission lines, stripline transmission lines, edge-coupled microstrip transmission lines, edge-coupled stripline transmission lines, waveguide structures for conveying signals at millimeter wave frequencies, transmission lines formed from combinations of transmission lines of these types, etc. Transmission lines in device 10 may be integrated into rigid and/or flexible printed circuit boards. In one suitable arrangement, transmission lines in device 10 may also include transmission line conductors (e.g., signal and ground conductors)

integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive). Filter circuitry, switching circuitry, impedance matching circuitry, and other circuitry may be interposed within the transmission lines, if desired.

Device 10 may contain multiple antennas 40. The antennas may be used together or one of the antennas may be switched into use while other antenna(s) are switched out of use. If desired, control circuitry 14 may be used to select an optimum antenna to use in device 10 in real time and/or to select an optimum setting for adjustable wireless circuitry associated with one or more of antennas 40. Antenna adjustments may be made to tune antennas to perform in desired frequency ranges, to perform beam steering with a phased antenna array, and to otherwise optimize antenna performance. Sensors may be incorporated into antennas 40 to gather sensor data in real time that is used in adjusting antennas 40.

In some configurations, antennas 40 may include antenna arrays (e.g., phased antenna arrays to implement beam steering functions). For example, the antennas that are used in handling millimeter wave signals for extremely high frequency wireless transceiver circuits 28 may be implemented as phased antenna arrays. The radiating elements in a phased antenna array for supporting millimeter wave communications may be patch antennas, dipole antennas, Yagi (Yagi-Uda) antennas, or other suitable antenna elements. Transceiver circuitry 28 can be integrated with the phased antenna arrays to form integrated phased antenna array and transceiver circuit modules or packages if desired.

In devices such as handheld devices, the presence of an external object such as the hand of a user or a table or other surface on which a device is resting has a potential to block wireless signals such as millimeter wave signals. In addition, millimeter wave communications typically require a line of sight between antennas 40 and the antennas on an external device. Accordingly, it may be desirable to incorporate multiple phased antenna arrays into device 10, each of which is placed in a different location within or on device 10. With this type of arrangement, an unblocked phased antenna array may be switched into use and, once switched into use, the phased antenna array may use beam steering to optimize wireless performance. Similarly, if a phased antenna array does not face or have a line of sight to an external device, another phased antenna array that has line of sight to the external device may be switched into use and that phased antenna array may use beam steering to optimize wireless performance. Configurations in which antennas from one or more different locations in device 10 are operated together may also be used (e.g., to form a phased antenna array, etc.).

Figure 2:
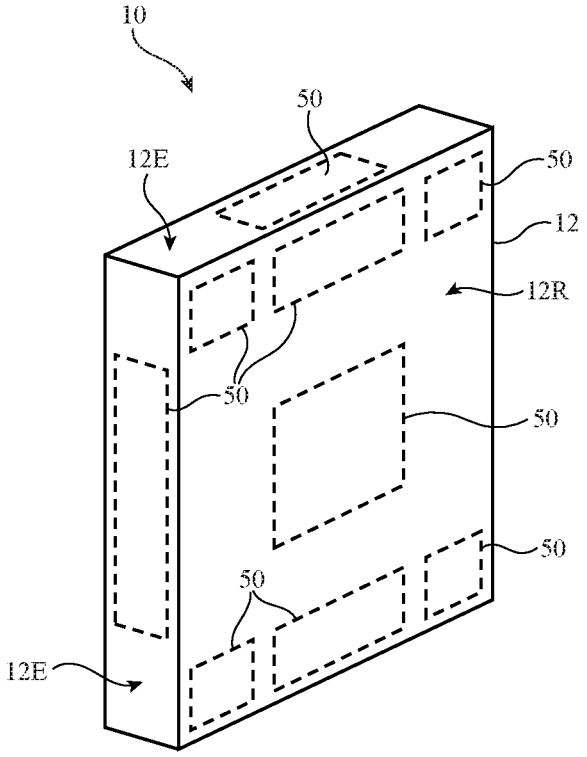
FIGS. 2 and 3 are perspective views of an illustrative electronic device showing locations at which phased antenna arrays for millimeter wave communications may be located in accordance with an embodiment.

FIG. 2 is a perspective view of electronic device 10 showing illustrative locations 50 at which antennas 40 (e.g., single antennas and/or phased antenna arrays for use with wireless circuitry 34 such as millimeter wave wireless transceiver circuitry 28 in FIG. 1) may be mounted in device 10. As shown in FIG. 2, housing 12 of device 10 may include rear housing wall 12R (sometimes referred to as wall 12R, rear housing portion 12R, or rear housing surface 12R) and housing sidewalls 12E. In one suitable arrangement, a display may be mounted to the side of housing 12 opposing rear housing wall 12R.

Antennas 40 (e.g., single antennas 40 or arrays of antennas 40) may be mounted at locations 50 at the corners of device 10, along the edges of housing 12 such as on sidewalls 12E, on the upper and lower portions of rear housing portion 12R, in the center of rear housing 12 (e.g., under a dielectric window structure such as a plastic logo), etc. In configurations in which housing 12 is formed from a dielectric, antennas 40 may transmit and receive antenna signals through the dielectric, may be formed from conductive structures patterned directly onto the dielectric, or may be formed on dielectric substrates (e.g., flexible printed circuit board substrates) formed on the dielectric. In configurations in which housing 12 is formed from a conductive material such as metal, slots or other openings may be formed in the metal that are filled with plastic or other dielectric. Antennas 40 may be mounted in alignment with the dielectric (i.e., the dielectric in housing 12 may serve as one or more antenna windows for antennas 40) or may be formed on dielectric substrates (e.g., flexible printed circuit board substrates) mounted to external surfaces of housing 12.

Figure 3:
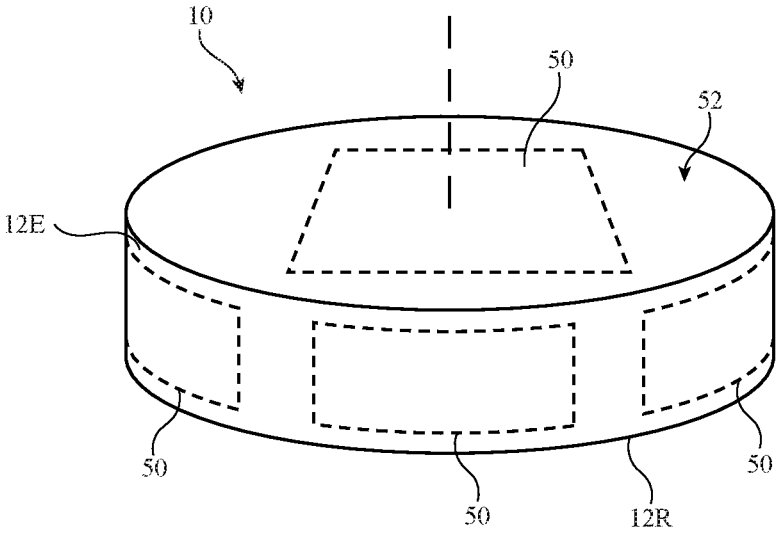

In the example of FIG. 2, rear housing wall 12R has a rectangular periphery. Housing sidewalls 12E surround the rectangular periphery of wall 12R and extend from wall 12R to the opposing face of device 10. In another suitable arrangement, device 10 and housing 12 may have a cylindrical shape. As shown in FIG. 3, rear housing wall 12R has a circular or elliptical periphery. Rear housing wall 12R may oppose surface 52 of device 10. Surface 52 may be formed from a portion of housing 12, may be formed from a display or transparent display cover layer, or may be formed using any other desired device structures. Housing sidewall 12E may extend between surface 52 and rear housing wall 12R. Antennas 40 may be mounted at locations 50 along housing sidewall 12E, on surface 52, and/or on wall 12R. By forming phased antenna arrays at different locations along wall 12E, on surface 52 (sometimes referred to herein as housing surface 52), and/or on rear housing wall 12R (e.g., as shown in FIGS. 2 and 3), the different phased antenna arrays on device 10 may collectively provide line of sight coverage to any point on a sphere surrounding device 10 (or on a hemisphere surrounding device 10 in scenarios where phased antenna arrays are only formed on one side of device 10).

The examples of FIGS. 2 and 3 are merely illustrative. In general, housing 12 and device 10 may have any desired shape or form factor. For example, rear housing wall 12R may have a triangular periphery, hexagonal periphery, polygonal periphery, a curved periphery, combinations of these, etc. Housing sidewall 12E may include straight portions, curved portions, stepped portions, combinations of these, etc. If desired, housing 12 may include other portions having any other desired shapes. The height of sidewall 12E may be less than, equal to, or greater than the length and/or width of housing rear wall 12R.

Figure 4:
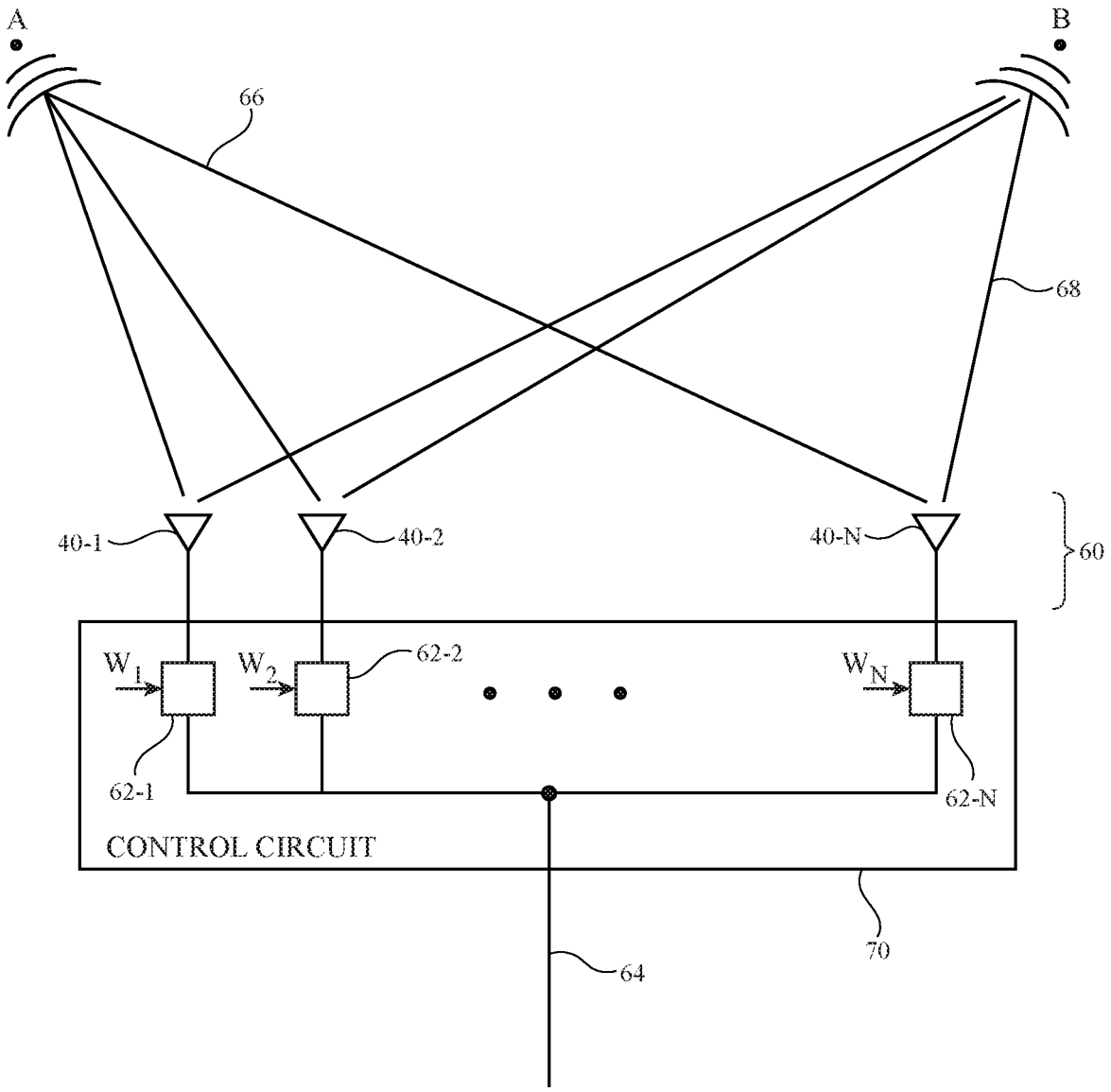
FIG. 4 is a diagram of an illustrative phased antenna array that may be adjusted using control circuitry to direct a beam of signals in accordance with an embodiment.

FIG. 4 shows how antennas 40 on device 10 may be formed in a phased antenna array. As shown in FIG. 4, phased antenna array 60 (sometimes referred to herein as array 60, antenna array 60, or array 60 of antennas 40) may be coupled to a signal path such as path 64 (e.g., one or more radio-frequency transmission line structures, extremely high frequency waveguide structures or other extremely high frequency transmission line structures, etc.). Phased antenna array 60 may include a number N of antennas 40 (e.g., a first antenna 40-1, a second antenna 40-2, an Nth antenna 40-N, etc.). Antennas 40 in phased antenna array 60 may be arranged in any desired number of rows and columns or in any other desired pattern (e.g., the antennas need not be arranged in a grid pattern having rows and columns). During signal transmission operations, path 64 may be used to supply signals (e.g., millimeter wave signals) from millimeter wave transceiver circuitry 28 (FIG. 1) to phased antenna array 60 for wireless transmission to external wireless equipment. During signal reception operations, path 64 may be used to convey signals received at phased antenna array 60 from external equipment to millimeter wave transceiver circuitry 28 (FIG. 1).

The use of multiple antennas 40 in phased antenna array 60 allows beam steering arrangements to be implemented by controlling the relative phases and amplitudes of the signals for the antennas. In the example of FIG. 4, antennas 40 each have a corresponding radio-frequency controllers 62 (sometimes referred to as controllers 62 or phase and magnitude controllers 62). For example, a first controller 62-1 is coupled between signal path 64 and first antenna 40-1, a second controller 62-2 is coupled between signal path 64 and second antenna 40-2, an Nth controller 62-N is coupled between path 64 and Nth antenna 40-N, etc. Controllers 62 may, for example, include phase adjustment circuitry that is controlled to provide a desired phase shift on the signals conveyed by the corresponding antenna 40 and/or gain (magnitude) adjustment circuitry (e.g., adjustable amplifier circuitry) that is controlled (e.g., biased) to provide a desired gain on signals conveyed by the corresponding antenna 40.

Beam steering circuitry such as control circuitry 70 (sometimes referred to herein as control circuit 70, circuit 70, or circuitry 70) may use controllers 62 or any other suitable phase and magnitude control circuitry to adjust the relative phases and/or magnitudes of the transmitted signals that are provided to each of the antennas in the antenna array and to adjust the relative phases of the received signals that are received by the antenna array from external equipment. The term "beam" or "signal beam" may be used herein to collectively refer to wireless signals that are transmitted and received by array 60 in a particular direction. The term "transmit beam" may sometimes be used herein to refer to wireless signals that are transmitted in a particular direction whereas the term "receive beam" may sometimes be used herein to refer to wireless signals that are received from a particular direction.

If, for example, control circuitry 70 is adjusted to produce a first set of phases and/or magnitudes on transmitted millimeter wave signals, the transmitted signals will form a millimeter wave frequency transmit beam as shown by beam 66 of FIG. 4 that is oriented in the direction of point A. If, however, control circuitry 70 adjusts controllers 62 to produce a second set of phases and/or magnitudes on the transmitted signals, the transmitted signals will form a millimeter wave frequency transmit beam as shown by beam 68 that is oriented in the direction of point B. Similarly, if control circuitry 70 adjusts controllers 62 to produce the first set of phases and/or magnitudes, wireless signals (e.g., millimeter wave signals in a millimeter wave frequency receive beam) may be received from the direction of point A as shown by beam 66. If control circuitry 70 adjusts controllers 62 to produce the second set of phases and/or magnitudes, signals may be received from the direction of point B, as shown by beam 68. Control circuitry 70 may be controlled by control circuitry 14 of FIG. 1 or by other control and processing circuitry in device 10 if desired.

In one suitable arrangement, controllers 62 may each include radio-frequency mixing circuitry. The mixing circuitry of controllers 62 may receive signals from path 64 at a first input and may receive a corresponding signal weight value W at a second input (e.g., mixing circuitry of controller 62-1 may receive a first weight $W_1$, mixing circuitry of controller 62-2 may receive a second weight $W_2$, mixing circuitry of controller 62-N may receive an Nth weight $W_N$, etc.). Weight values W may, for example, be provided by control circuitry 14 (e.g., using corresponding control signals) or from other control circuitry. The mixing circuitry may mix (e.g., multiply) the signals received over path 64 with the corresponding signal weight value to produce an output signal that is transmitted on the corresponding antenna. For example, a signal S may be provided to controllers 62 over path 64. Controller 62-1 may output a first output signal $S*W_1$ that is transmitted on first antenna 40-1, controller 62-2 may output a second output signal $S*W_2$ that is transmitted on second antenna 40-2, etc. The output signals transmitted by each antenna may constructively and destructively interfere to generate a beam of signals in a particular direction (e.g., in a direction as shown by beam 66 or a direction as shown by beam 68). Similarly, adjusting weights W may allow for millimeter wave signals to be received from a particular direction and provided to path 64. Different combinations of weights W provided to each mixer will steer the signal beam in different desired directions. If desired, control circuitry 70 may actively adjust weights W provided to controllers 62 in real time to steer the transmit or receive beam in desired directions.

When performing millimeter wave communications, millimeter wave signals are conveyed over a line of sight path between phased antenna array 60 and external equipment. If the external equipment is located at location A of FIG. 4, circuit 70 may be adjusted to steer the signal beam towards direction A. If the external equipment is located at location B, circuit 70 may be adjusted to steer the signal beam towards direction B. In the example of FIG. 4, beam steering is shown as being performed over a single degree of freedom for the sake of simplicity (e.g., towards the left and right on the page of FIG. 4). However, in practice, the beam is steered over two degrees of freedom (e.g., in three dimensions, into and out of the page and to the left and right on the page of FIG. 4).

Figure 5:
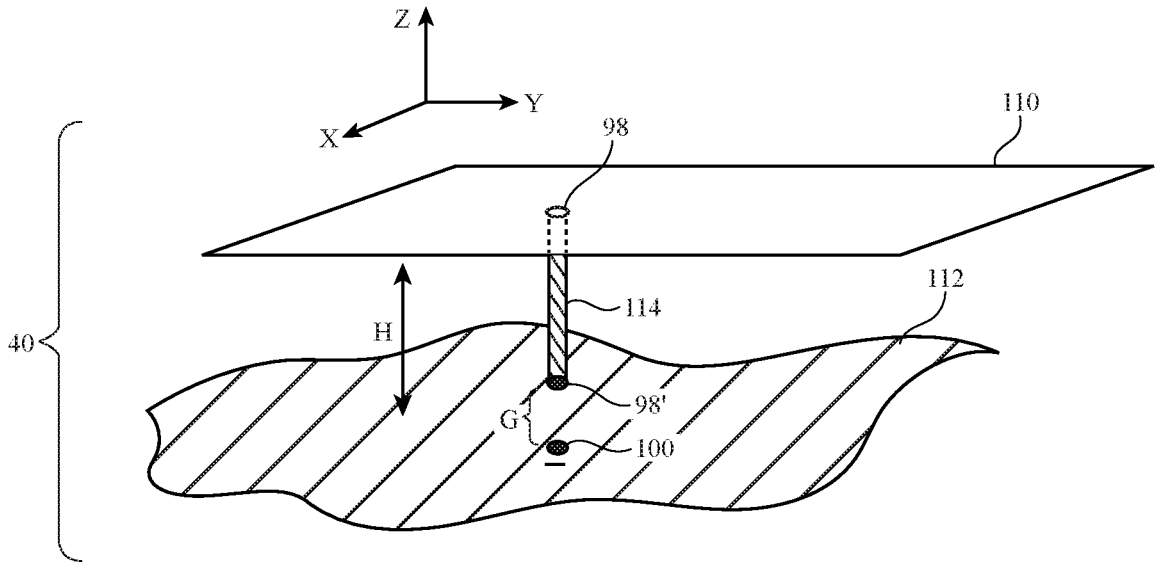
FIG. 5 is a perspective view of an illustrative patch antenna in accordance with an embodiment.

Any desired antenna structures may be used for implementing antenna 40. For example, patch antenna structures may be used for implementing antenna 40. Antennas 40 may therefore sometimes be referred to herein as patch antennas 40. An illustrative patch antenna is shown in FIG. 5. As shown in FIG. 5, patch antenna 40 may have a patch antenna resonating element such as patch element 110 that is separated from a ground plane structure such as ground 112 (sometimes referred to as ground layer 112 or grounding layer 112). Patch antenna resonating element 110 and ground 112 may be formed from metal foil, machined metal structures, metal traces on a printed circuit or a molded plastic carrier, electronic device housing structures, or other conductive structures in an electronic device such as device 10.

Patch antenna resonating element 110 may lie within a plane such as the X-Y plane of FIG. 5. Ground 112 may lie within a plane that is parallel to the plane of patch antenna resonating element (patch) 110. Patch 110 and ground 112 may therefore lie in separate parallel planes that are separated by a distance H. Conductive path 114 may be used to couple terminal 98' to terminal 98. Antenna 40 may be fed using a transmission line with a positive conductor coupled to terminal 98' (and thus terminal 98) and with a ground conductor coupled to terminal 100. Other feeding arrangements may be used if desired. Moreover, patch 110 and ground 112 may have different shapes and orientations (e.g., planar shapes, curved patch shapes, patch element shapes with non-rectangular outlines, shapes with straight edges such as squares, shapes with curved edges such as ovals and circles, shapes with combinations of curved and straight edges, etc.).

Figure 6:
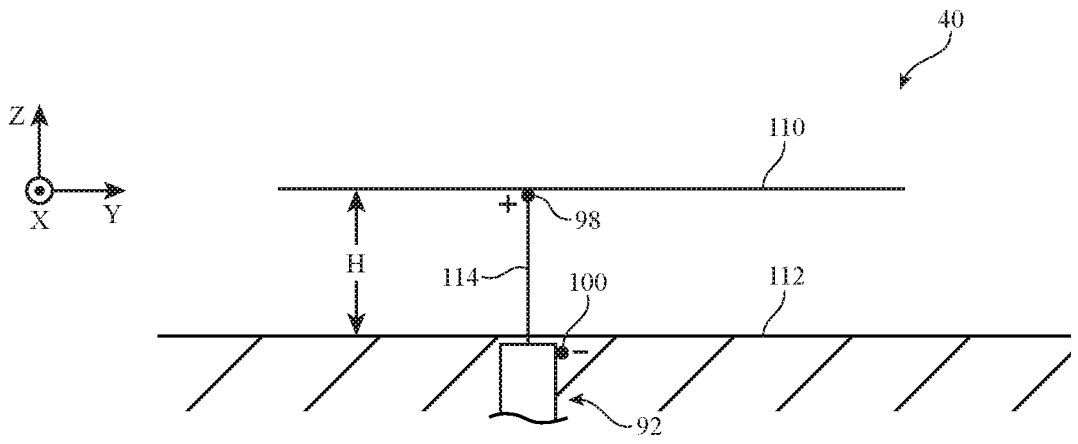
FIG. 6 is a side view of an illustrative patch antenna in accordance with an embodiment.

A side view of a patch antenna such as patch antenna 40 of FIG. 5 is shown in FIG. 6. As shown in FIG. 6, antenna 40 may be fed using an antenna feed (with terminals 98 and 100) that is coupled to a transmission line such as transmission line 92. Patch antenna resonating element 110 of antenna 40 may lie in a plane parallel to the X-Y plane of FIG. 6 and the surface of the structures that form ground (e.g., ground 112) may lie in a plane that is separated by vertical distance H from the plane of patch antenna resonating element 110. With the illustrative feeding arrangement of FIG. 6, a ground conductor of transmission line 92 is coupled to antenna feed terminal 100 on ground 112 and a positive conductor of transmission line 92 is coupled to antenna feed terminal 98 via an opening in ground 112 and conductive path 114 (which may be an extended portion of the transmission line's positive conductor). Other feeding arrangements may be used if desired (e.g., feeding arrangements in which a microstrip transmission line in a printed circuit or other transmission line that lies in a plane parallel to the X-Y plane is coupled to terminals 98 and 100, etc.). To enhance the frequency coverage and polarizations handled by antenna 40, antenna 40 may be provided with multiple feeds (e.g., two feeds) if desired. These examples are merely illustrative and, in general, the patch antenna resonating elements may have any desired shape. Other types of antennas may be used if desired.

Figure 7:
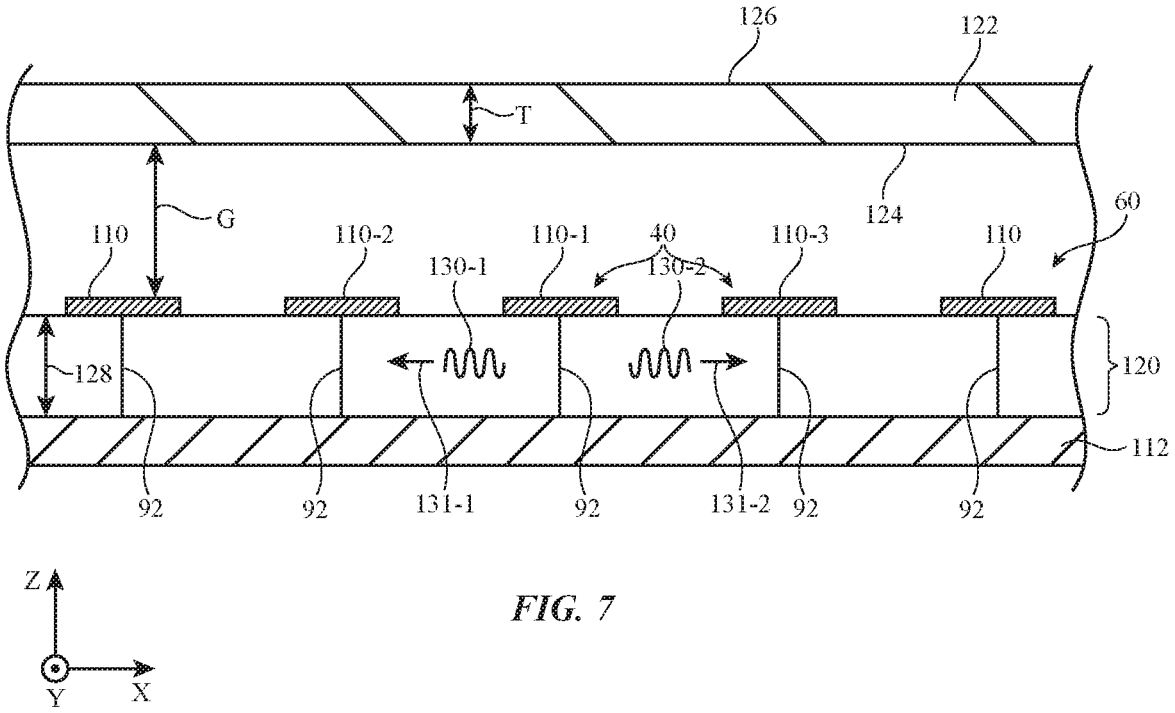
FIG. 7 is a cross-sectional side view of an illustrative antenna array covered by a planar dielectric cover in accordance with an embodiment.

Antennas of the types shown in FIGS. 5 and 6 and/or other types of antennas such as dipole antennas and Yagi antennas may be arranged in a phased antenna array such as phased antenna array 60 of FIG. 4. FIG. 7 is a cross-sectional side view of an illustrative patch antenna array 60 formed from a pattern of patch antennas (e.g., antennas of the types shown in FIGS. 5 and 6). As shown in FIG. 7, multiple patch antennas 40 may be arranged in antenna array 60. Antenna resonating elements 110 (sometimes referred to herein as antenna elements 110, elements 110, patch antenna resonating elements 110, patch elements 110, or resonating elements 110) of respective antennas 40 may be formed at different locations over ground plane 112. While FIG. 7 shows a side view of array 60, array 60 may have patch antennas arranged in a two-dimensional grid pattern (e.g., arranged in a rectangular array pattern of rows and columns, arranged in a 5×5 array, etc.) or any other desired pattern. While FIG. 7 shows five patch antennas, this is merely illustrative. If desired, any number of patch antennas may be formed in array 60. The example of antenna elements 110 being patch antenna elements is merely illustrative. Antenna resonating elements 110 may be dipole antenna resonating elements, Yagi antenna resonating elements, or antenna resonating elements of any other desired type.

Respective transmission lines 92 may couple a corresponding antenna resonating element 110 to transceiver circuitry 28 (e.g., transceiver circuitry 28 of FIG. 1) through substrate 120. Transmission lines 92 may also couple transceiver circuitry 28 to ground 112. As an example, ground 112 may be shared between multiple antenna elements 110 in FIG. 7. Elements 110 may be formed on a dielectric substrate such as substrate 120. Substrate 120 may be a printed circuit, dielectric (e.g., plastic ceramic, foam, glass, etc.) support structure, or any other suitable structure on which elements 110 may be formed.

As previously described, array 60 may be located at any desired location (e.g., locations 50 in FIGS. 2 and 3). In order to protect array 60 from damage, dust, water, and other contaminants and for the purposes of mechanical reliability of the antenna assembly, a dielectric cover layer such as cover layer 122 (sometimes referred to as cover 122, dielectric cover 122, or radome 122) may be formed over array 60. The dielectric properties and the geometry of cover layer 122 may affect the radiation characteristics of array 60.

As shown in FIG. 7, cover layer 122 may be separated from antenna elements 110 of array 60 by a gap such as gap G. Gap G may be filled with a dielectric material such as plastic, foam, air, etc. Cover 122 may be formed from any desired dielectric material. As examples, cover 122 may be formed from plastic, glass, ceramics, fiber composites, a combination of two or more of these materials, or any other suitable materials. Cover 122 may be formed from a portion of housing 12 (e.g., from a dielectric antenna window portion of housing 12 or other dielectric portions of housing 12) or any other dielectric structures of device 10. If desired, some or all of cover 122 may be formed from internal structures within device 10 (e.g., internal printed circuits, dielectric support structures, etc.).

In the example of FIG. 7, dielectric cover 122 has a uniform thickness T across the lateral area of array 60. Thickness T may be defined by planar lower surface 124 and planar upper surface 126. Surfaces 124 and 126 may lie in parallel planes with respect to a surface of elements 110, a surface of substrate 120, and/or a surface of ground 112. As an example, cover 122 may completely encapsulate elements 110 and/or a top surface of substrate 120. In other words, cover 122 and substrate 120 may form a closed cavity in which elements 110 are located. Surface 124 may sometimes be referred to herein as an inner surface, whereas surface 126 may sometimes be referred to herein as an outer surface (e.g., because inner surface 124 faces antennas 40 whereas outer surface 126 may, in some scenarios, be formed at the exterior of device 10).

During operation of antennas 40 in array 60, the transmission and reception of signals such as millimeter wave signals may be affected by the presence of cover 122 (e.g., by the geometry of cover 122 with respect to elements 40 and by the dielectric properties of cover 122). In particular, signals generated by array 60 may be reflected at the air-solid interfaces of cover 122 (e.g., at surfaces 124 and 126 which may be referred to as interfacial surfaces 124 and 126 or interfaces 124 and 126). As a result, only a portion of signals generated by array 60 may be transmitted through cover 122. Additionally, the reflected portion of the transmit signals of array 60 may distort other transmit signals of array 60 (e.g., reflected signals that are 180 degrees out of phase with transmitted signals may destructively interfere with the transmitted signals). For example, if care is not taken, in the presence of flat cover 122 in FIG. 7 the peak gain of the signals transmitted by array 60 may be deteriorated, the radiation pattern of the signals generated by array 60 may be narrowed (e.g., to provide an excessively small wireless coverage area), the radiation pattern of the signals generated by array 60 may be otherwise distorted, etc. It may therefore be desirable to provide dielectric covers that can mitigate these adverse effects.

In the example of FIG. 7, the size of gap G may be selected, the thickness T of cover 122 may be selected, and/or the dielectric material used to form cover 122 may be selected to minimize these adverse effects. In particular, thickness T of cover 122 may be an optimal thickness such that the respective reflected signals generated at surfaces 124 and 126 interfere with each other destructively (e.g., cancel each other out). In other words, out-of-phase reflected signals (e.g., signals that have an approximately 180-degree phase difference with respect to each other) generated at surface 124 and 126 may cancel each other out. The optimal thickness in this example may be determined by the wavelength of the signals propagating through cover 122 and the dielectric constant of cover 122. As an example, an optimal thickness of cover 122 may be the wavelength of operation of array 60 divided by two, or any other desired thickness that minimizes distortion of the radiation pattern.

Other factors may affect the efficiency of antennas 40 in phased antenna array 60. Two possible sources of losses for antennas 40 (that accordingly decrease efficiency of the antennas) are substrate losses (e.g., losses associated with the material of substrate 120) and surface wave losses. Surface wave losses may, for example, be directly proportional to the thickness 128 of substrate 120. To mitigate surface wave losses, it may therefore be desirable to decrease the thickness of substrate 120. However, at the same time, the bandwidth of antennas 40 is directly proportional to the volume of antennas 40 (and thus the thickness of substrate 120). If care is not taken, it can be difficult to mitigate surface wave losses while also providing the antennas with satisfactory bandwidth.

Isolating antennas 40 in phased antenna array 60 may also be important in improving antenna performance. As discussed previously, beam steering techniques may be used (e.g., schemes in which antenna signal phase and/or magnitude for each antenna in an array is adjusted to perform beam steering) to achieve high throughput with phased antenna array 60 using millimeter and centimeter wave communications. Poor isolation between antennas 40 in phased antenna array 60 may make it difficult to accurately implement beamforming algorithms and may negatively affect the transmitted antenna patterns.

When an antenna 40 in phased antenna array 60 is used to convey radio-frequency signals, surface waves may be generated by the antenna. For example, antenna element 110-1 may be used to convey extremely high frequency (EHF) signals or other wireless signals at frequencies greater than 10 GHz. Conveying the EHF signals may excite electromagnetic surface waves such as surface waves 130-1 and 130-2 in the volume between elements 110 and ground 112. For example surface waves may propagate in a lateral direction away from element 110-1 (e.g., in the X-Y plane of FIG. 7) such as in direction 131-1 towards antenna element 110-2, as shown by surface wave 130-1, and in direction 131-2 towards antenna element 110-3, as shown by surface wave 130-2. The surface waves may electromagnetically couple with the adjacent antenna elements and thereby interfere with signals conveyed using the adjacent antenna elements (e.g., antenna elements 110-2 and 110-3).

To mitigate interference between adjacent antennas due to surface waves and to decrease substrate losses, surface wave mitigation structures may be formed in array 60. The surface wave mitigation structures may be formed by removing portions of substrate 120 that are not covered by antennas, for example. An arrangement of this type is shown in FIG. 8.

Figure 8:
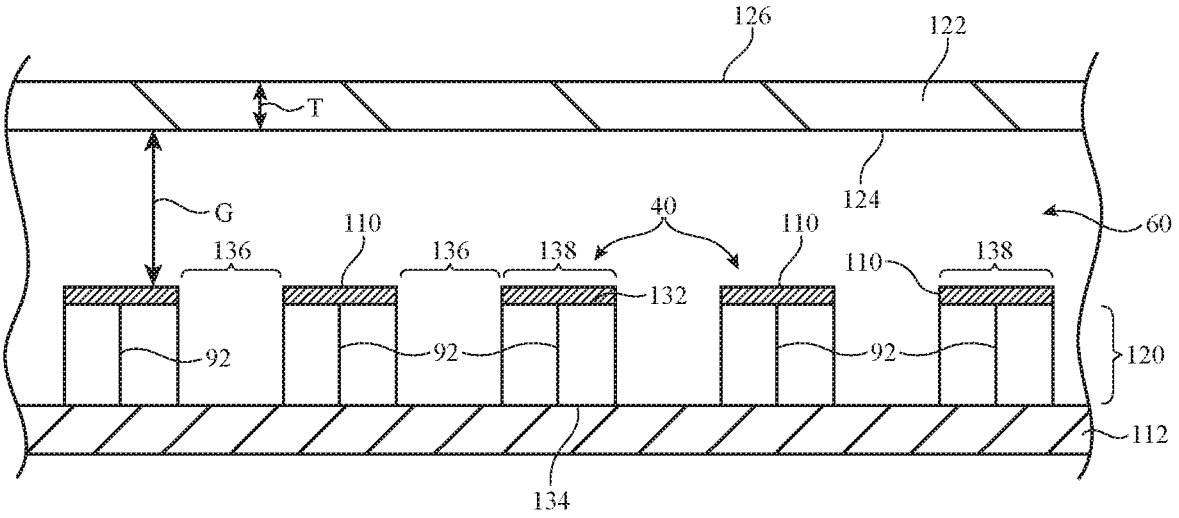
FIG. 8 is a cross-sectional side view of an illustrative antenna array with a substrate that has etched portions in accordance with an embodiment.

FIG. 8 is a cross-sectional side view of a phased antenna array showing how substrate 120 may be etched (e.g., patterned) to improve isolation between adjacent antennas. As shown in FIG. 8, substrate 120 for antenna array 60 may be etched in regions (e.g., regions 136, sometimes referred to as etched regions 136) between resonating elements 110. Portions of the substrate 120 underneath resonating elements 110 (e.g., portions (regions) 138, sometimes referred to as islands or remaining portions) may not be etched. If desired, as shown in FIG. 8, the upper surface 132 and/or the lower surface 134 of substrate 120 may be planar.

In general, the generation of surface waves at EHF frequencies may be dependent upon a relatively continuous dielectric permittivity of substrate 120. However, removing portions of substrate 120 between adjacent antenna elements may create discontinuities in the permittivity of substrate 120. These discontinuities may serve to prevent surface wave generation and thus interference by the surface waves on adjacent antennas. Removing portions of substrate 120 between adjacent antenna elements may also reduce substrate losses.

Figure 9:
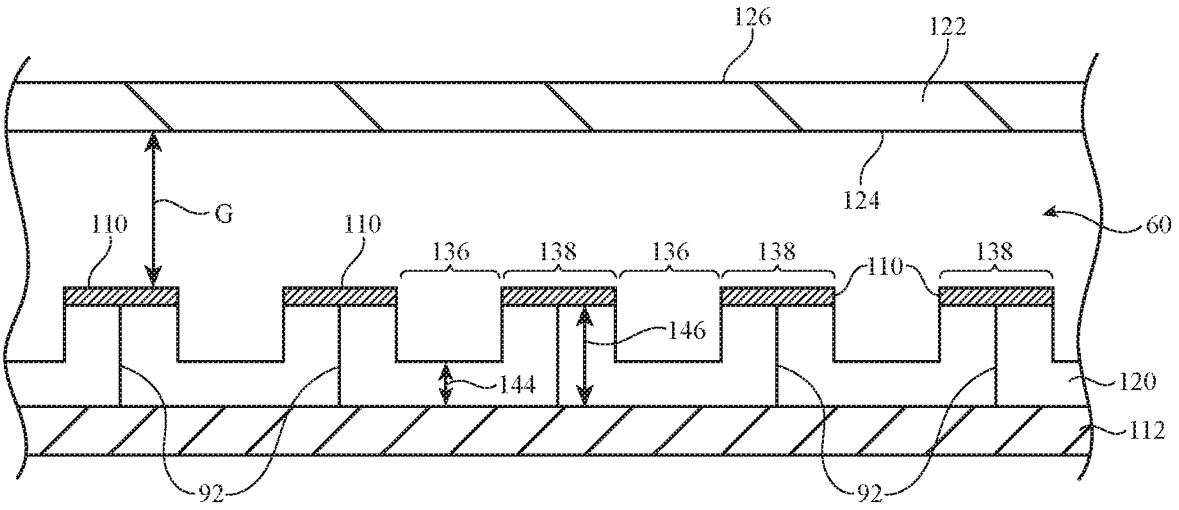
FIG. 9 is a cross-sectional side view of an illustrative antenna array with a substrate that has partially etched portions in accordance with an embodiment.

In FIG. 8, substrate 120 is totally removed in regions 136 between antenna resonating elements 110 (e.g., no portions of the dielectric material of substrate 120 may remain in regions that are not overlapped by resonating elements 110). However, this example is merely illustrative. If desired, substrate 120 may be partially removed or thinned (e.g., etched) in regions 136 between resonating elements 110. An arrangement of this type is shown in FIG. 9. As shown in FIG. 9, substrate 120 has a thickness 144 in etched regions 136 and a thickness 146 in portions 138 that have not been etched. Thickness 146 may be greater than thickness 144. Thickness 144 of each etched portion of substrate 120 may be the same across the substrate or may vary across the substrate. For example, the thickness of the substrate between first and second resonating elements 110 may be different or the same as the thickness of the substrate between second and third resonating elements 110. Etching regions 136 of substrate 120 in this way may improve isolation between the antennas in phased antenna array 60 due to decreased surface wave interference.

Figure 10:
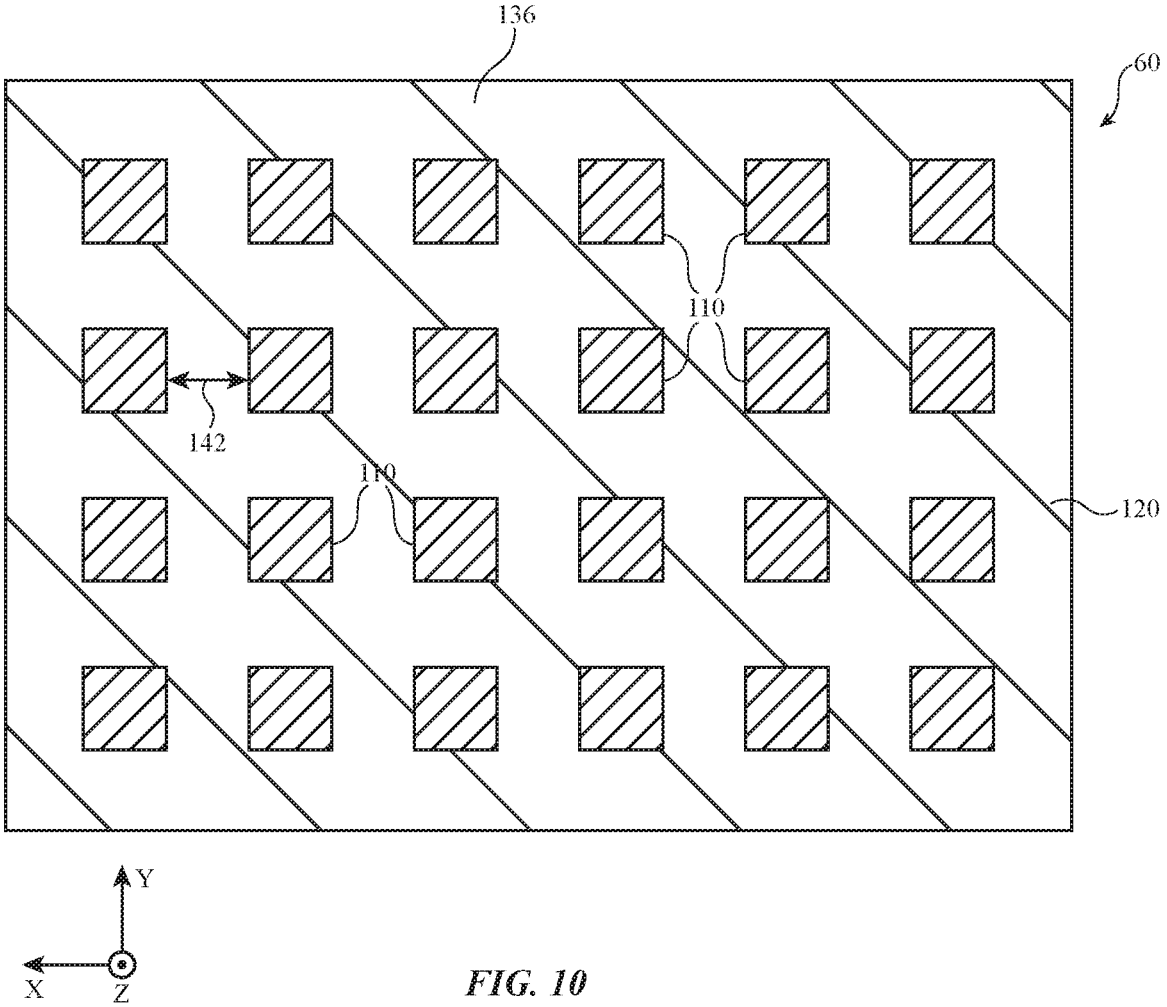
FIG. 10 is a top view of an illustrative antenna array with etched portions interposed between respective row and columns of antenna resonating elements in accordance with an embodiment.
Figure 11:
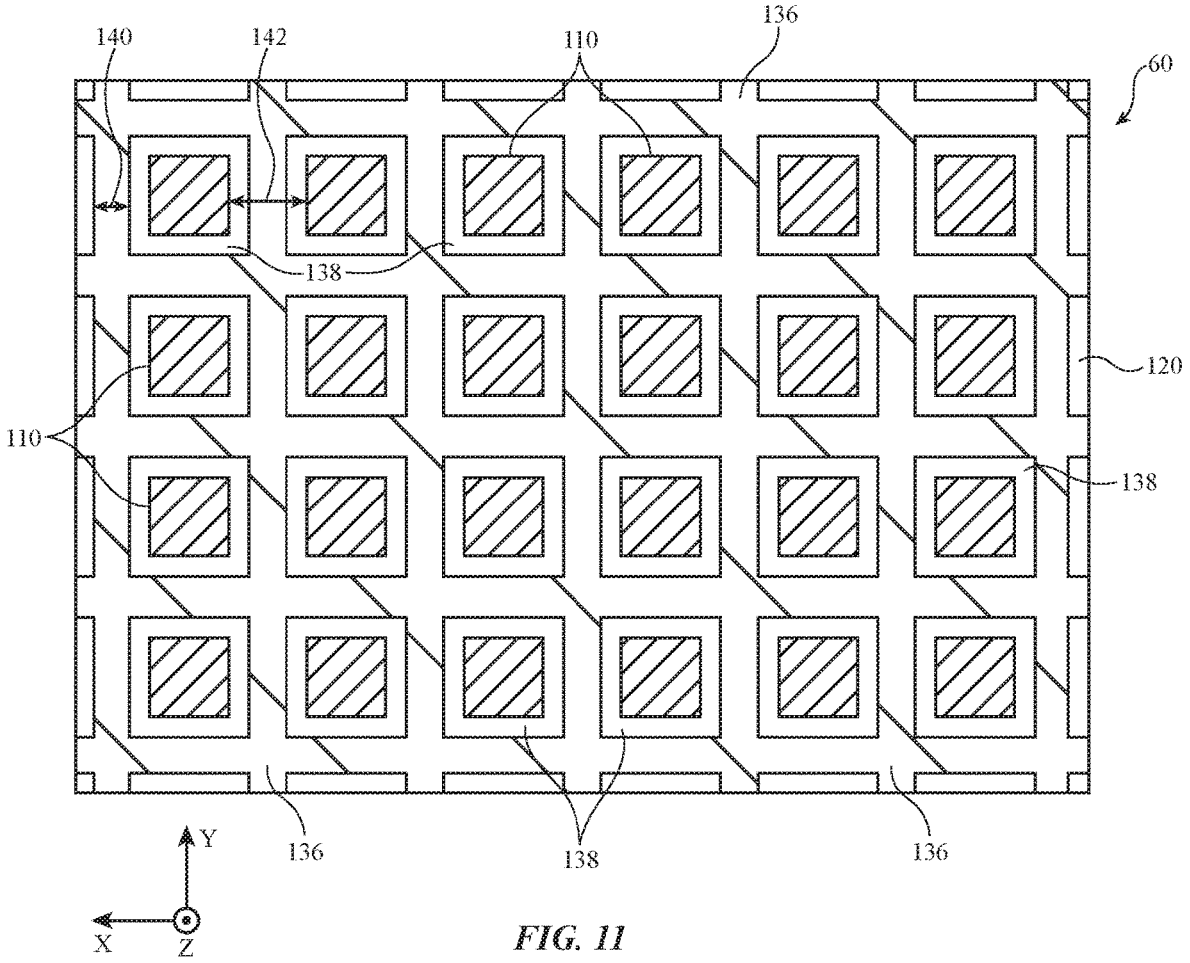
FIG. 11 is a top view of an illustrative antenna array with etched portions that have a width that is less than a distance between adjacent antenna resonating elements in accordance with an embodiment.

FIGS. 10 and 11 are top views of illustrative phased antenna arrays with etched substrates. As shown in FIG. 10, substrate 120 may support an array of antenna resonating elements 110. Substrate 120 has etched regions 136 between antenna resonating elements 110. Etched regions 136 of substrate 120 have a smaller thickness than regions of substrate 120 that have not been etched (e.g., portions 138 in FIGS. 8 and 9). In some cases, the substrate 120 may be completely removed in etched regions 136 (e.g., the thickness of the substrate may be 0). An arrangement of this type is also shown in FIG. 8, as an example. In other cases, substrate 120 may not be completely removed in etched regions 136 (e.g., the thickness of the substrate in etched regions 136 may be greater than 0 but less than the thickness of the substrate in regions 138). An arrangement of this type is shown in FIG. 9, as an example.

In FIG. 10, there are etched regions 136 between each set of adjacent columns of antenna resonating elements 110 and between each set of adjacent rows of antenna resonating elements 110. An etched region may be interposed between each pair of antenna elements in phased antenna array 60. The etched regions may totally surround each antenna resonating element (e.g., may totally laterally surround each antenna resonating element in the X-Y plane). Accordingly, the antennas may sometimes be referred to as island antennas. In the embodiment of FIG. 10, each etched region 136 may include all portions of substrate 120 between antenna resonating elements 110. In other words, the distance (142) between adjacent antenna resonating elements 110 may be the same as the width of each etched region 136. The example of FIG. 10 is merely illustrative, and substrate 120 may include one or more etched regions of any desired depth, thickness, and shape. If desired, the etched regions may be along one, two, three, or four sides of one more of the patches in the array.

In another possible arrangement, shown in FIG. 11, the width of etched regions 136 may be less than the distance between adjacent antenna resonating elements. As shown in FIG. 11, etched region 136 may have a width 140 that is less than the distance 142 between adjacent resonating elements. Width 140 may be any desired percentage (e.g., 90%, 80%, 50%, greater than 50%, less than 50%, between 20 and 80%, greater than 10%, less than 90%) of distance 142. In general, the etched region between each pair of antenna resonating element may have any desired width. The etched regions also do not have to be centered between adjacent antenna elements. For example, an etched region may be formed closer to a first antenna resonating element than a second, adjacent, antenna resonating element.

The examples of FIGS. 10 and 11 are merely illustrative. If desired, substrate 120 may include any desired number of etched regions. Each etched region may have any desired width (e.g., equal to the distance between adjacent resonating elements or less than the distance between adjacent resonating elements) and any desired thickness (e.g., the thickness of the substrate may be 0 in the etched regions or the thickness of the substrate in the etched regions may be greater than 0 but less than the thickness of the substrate in the regions that are not etched). The examples of FIGS. 10 and 11 show arrangements where the etched regions extend completely across the substrate. However, the etched regions may have a shorter length such that the etched regions extend only partially across the substrate. Furthermore, the etched regions may extend in any desired direction. The example of FIGS. 10 and 11 where antenna resonating elements 110 are arranged in a grid with rows and columns of resonating elements is merely illustrative. Each resonating element 110 may have any desired location. Additionally, each antenna resonating element 110 may have any desired shape (e.g., antenna resonating elements 110 may have different shapes) and the antenna resonating elements may be arranged in any desired pattern.

In the examples of FIGS. 10 and 11, etched regions 136 run vertically between adjacent columns of antenna resonating elements 110 (e.g., parallel to the Y-axis as shown in FIG. 11) and horizontally between adjacent rows of antenna resonating element 110 (e.g., parallel to the X-axis as shown in FIG. 11). These examples are merely illustrative. The etched regions of the substrate may extend vertically, horizontally, or diagonally through the substrate. Additionally, the etched regions of the substrate may be curved or follow a meandering path if desired. Moreover, in FIGS. 10 and 11 the etched regions extend both horizontally and vertically. These examples are merely illustrative. If desired, the substrate may only include etched regions that extend vertically (e.g., between adjacent columns of antenna elements) or may only include etched regions that extend horizontally (e.g., between adjacent rows of antenna elements). These types of arrangements may still improve isolation due to decreased surface wave coupling between antenna elements in one direction. Including etched regions that extend vertically and horizontally may further improve isolation due to decreased surface wave coupling between antenna elements in two directions. In general, any desired number of etched regions may be included in substrate 120.

Referring to regions 136 in FIGS. 8-11 as etched regions is merely illustrative. Regions 136 may be formed by etching substrate 120 (e.g., using photolithography techniques) or any other desired method. For example, the regions may be formed by using a mask during a deposition of substrate material or using a cutting tool. The regions may therefore sometimes be referred to as thinned regions (e.g., thinned regions 136), removed regions (e.g., removed regions 136), cavities (e.g., cavities 136), notches (e.g., notches 136), recesses (e.g., recesses 136), slots (e.g., slots 136), grooves (e.g., grooves 136), dielectric-free regions (portions) (e.g., dielectric-free regions 136), and/or empty regions (portions) (e.g., empty regions 136). The regions may sometimes be referred to as air gaps that are interposed between substrate portions (e.g., air gaps 136 between substrate portions 138) that are underneath corresponding antenna elements. The recesses 136 may be filled with air or any other dielectric material(s) having a permittivity that is sufficiently different than the permittivity of substrate 120 (e.g., where a difference between the permittivity of the substrate and the permittivity of the dielectric material is greater than a threshold). Moreover, etched regions 136 may sometimes be referred to as a collective singular etched region (e.g., etched region 136 with different portions such as vertically extending portions and horizontally extending portions). Substrate 120 may be considered patterned to define recesses (or a collective singular recess with different portions) between each pair of antenna elements (e.g., un-etched portions 138 may define recesses in regions 136 between each pair of antenna elements). Because the recesses may mitigate surface waves in substrate 120, recesses 136 may sometimes be referred to as surface-wave-mitigating recesses. Substrate 120 may also be described as including surface-wave-mitigating structures (e.g., recesses 136).

In some of the aforementioned embodiments, the un-etched portions of the dielectric substrate (e.g., portions 138 in FIG. 9) have a width (and/or shape) that matches the respective antenna resonating element supported by the portion of the dielectric substrate. However, this example is merely illustrative. The un-etched portions of the dielectric substrate (sometimes referred to as islands) do not have to follow the shape of the supported antenna resonating element. For example, the antenna resonating element can take up any desired amount of lateral area on the island (e.g., 90%, greater than 90%, greater than 95%, greater than 75%, greater than 50%, greater than 25%, between 60 and 95%, less than 100%, less than 90%, less than 60%, etc.).

As discussed in connection with FIG. 7, the dimensions of dielectric cover 122 (in FIG. 7) may be selected to mitigate adverse effects caused by reflections of incident signals off the dielectric cover (e.g., the peak gain of the signals transmitted by array 60 may be deteriorated, the radiation pattern of the signals generated by array 60 may be narrowed, the radiation pattern of the signals generated by array 60 may be otherwise distorted, etc.). In the examples of FIGS. 7-9, dielectric cover 122 has a planer upper surface and planar lower surface. However, this example is merely illustrative. In order to mitigate the distortion of the radiation pattern for antenna signals by the dielectric cover, the dielectric cover may include one or more curved inner surfaces. The curved inner surfaces may help to reduce the incident angle of the signal beam generated by steering array 60. This consequently lowers interfacial reflection of the incident signals, resulting in the transmission of more of the antenna signals through the dielectric cover relative to scenarios where the dielectric cover has a planar inner surface (e.g., cover 122 in FIG. 7).

Figure 12:
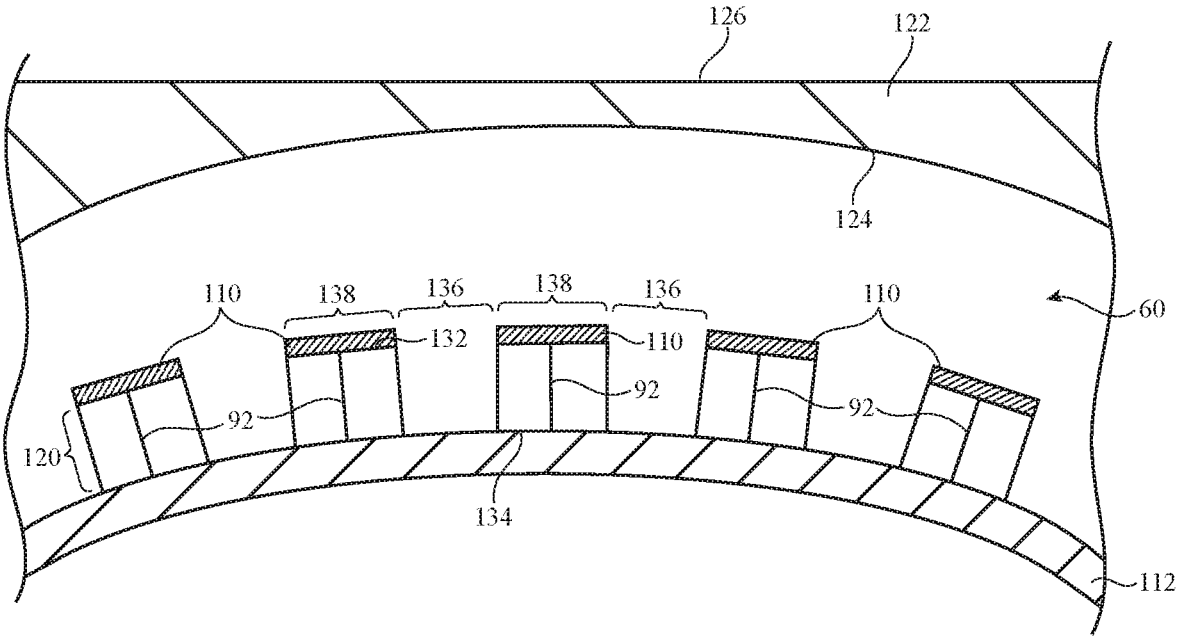
FIG. 12 is a cross-sectional side view of an illustrative antenna array with etched portions in a substrate that promote bending in accordance with an embodiment.

FIG. 12 shows a cross-sectional side view of an illustrative dielectric cover 122 for array 60 that has a curved inner surface such as curved inner surface 124 and planar outer surface 126. Curved inner surface 124 may, for example, have a spherical curvature, an elliptical curvature, or any other desired type of curvature. Because inner surface 124 is curved, cover 122 may exhibit a variable thickness across its lateral area if desired (as shown in the example of FIG. 12). For example, the edge portions of cover 122 around the periphery of array 60 may be thicker than a center portion of cover 122 over the center of array 60. This is merely illustrative. If desired, curved inner surface 124 may have a convex curve or any other suitable curvature.

Curved inner surface 124 of cover 122 in FIG. 12 may help to lower the incident angles at which signals transmitted by antenna resonating elements 110 reach surface 124. By lowering the incident angle of the transmit signals, interface reflection at surface 124 may be decreased and consequently a larger portion of the millimeter wave signals generated by array 60 may be transmitted through cover 122 than if a dielectric cover having a planar inner surface was used. Additionally, concave surface 124 of cover 122 may function as a concave lens for antennas 40 in array 60 and help broaden the radiation pattern of the signal beam transmitted by array 60.

The dielectric cover and antenna array may be placed at various locations within or on electronic device 10 that are adjacent to other internal structures or device housing structures. In order to adapt to the confines of the adjacent internal structures and/or housing structures (e.g., to the form factor of device 10) while minimizing high incident-angle reflections at the surfaces of the cover, both the inner surface and the outer surface of a dielectric cover may have curved surfaces. In one illustrative example, dielectric cover 122 may have a uniform thickness with curved upper and lower surfaces. In another illustrative example, dielectric cover 122 may have curved upper and lower surfaces and a non-uniform thickness (the degrees of curvature of the upper and lower surfaces may be different). If desired, the dielectric cover may include multiple discrete cavities (e.g., a corresponding cavity or curved lower surface for each respective antenna element 110 in array 60).

Curving one or more portions of inner surface 124 may mitigate distortions in the radiation pattern for the antenna signals by the dielectric cover. To further reduce the incident angle of the signal beam generated by steering array 60 and further lower interfacial reflection of the incident signals, array 60 (and substrate 120) may be curved in addition to dielectric cover 122 (resulting in the transmission of more of the antenna signals through the dielectric cover relative to scenarios where the array is planar). FIG. 12 shows an arrangement of this type.

Removing portions of substrate 120 to reduce substrate losses and interference due to surface waves (as discussed in connection with FIGS. 7-11) may have the additional benefit of promoting bending of substrate 120. For the reasons discussed above, bending substrate 120 of phased antenna array 60 may be desirable to improve antenna performance. However, in some configurations substrate 120 may be formed from a fairly rigid material, thus making it difficult to bend substrate 120 as desired. Etching portions of substrate 120 (e.g., to reduce substrate losses and/or interference due to surface waves) may also promote bending of substrate 120 for improved antenna performance.

As shown in FIG. 12, substrate 120 with antenna resonating elements 110 and underlying ground layer 112 may be curved (bent). Substrate 120 may have an upper surface 132 that is curved. If desired, the curvature of upper surface 132 may be the same as the curvature of lower surface 124 of the dielectric cover (e.g., lower surface 124 of the dielectric cover may be parallel to upper surface 132 of the substrate 120). In FIG. 12, lower surface 134 of substrate 120 is shown as being curved (e.g., lower surface 134 may have curvature that matches the curvature of upper surface 132). However, this example is merely illustrative and lower surface 134 may instead be planar. If desired, the upper surface 132 and/or the lower surface 134 of substrate 120 may be planar (with the curvature of the underling ground layer 112 resulting in the signals from resonating elements 110 having a low incident angle on lower surface 124).

Etching substrate 120 may therefore reduce substrate losses, mitigate interference between adjacent antennas due to surface wave coupling, and promote bending of substrate 120 and ground layer 112 (thus improving antenna performance).

Figure 13:
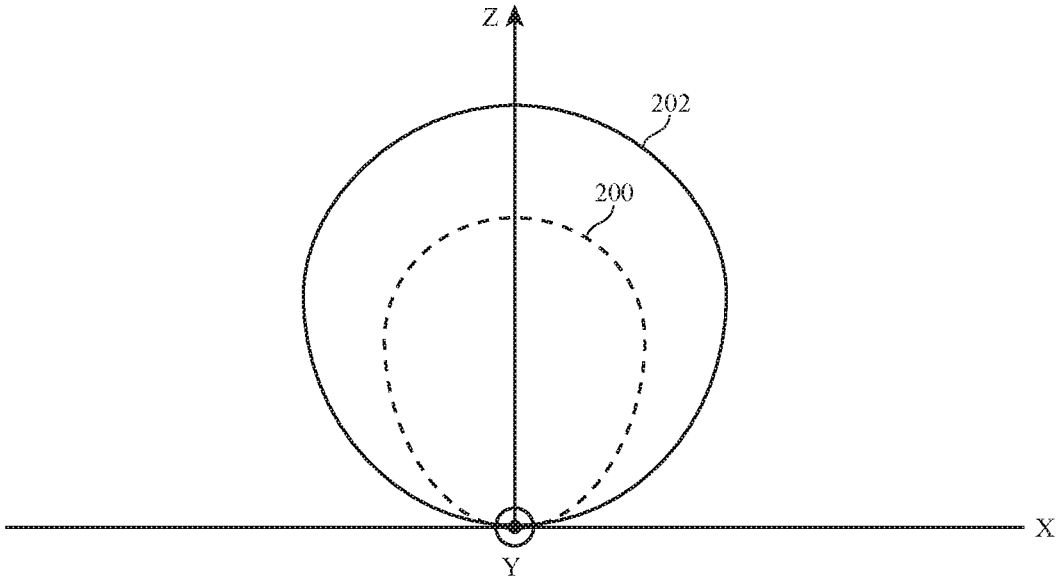
FIG. 13 is a diagram of illustrative antenna radiation patterns associated with phased antenna arrays such as the phased antenna arrays of FIGS. 7-12 in accordance with an embodiment.

FIG. 13 shows a diagram of illustrative radiation patterns (e.g., radiation pattern envelopes) of phased antenna array 60 with and without surface-mitigating structures such as surface-wave-mitigating recesses 136 in FIG. 8. In the perspective of FIG. 13, antenna array 60 may lie in the X-Y plane of FIG. 13. As shown in FIG. 13, curve 200 illustrates a radiation pattern envelope of phased antenna array 60 without any surface-wave-mitigating structures (e.g., the phased antenna array of FIG. 7) placed in the X-Y plane and radiating in the Z-direction. However, when surface-wave-mitigating structures such as recesses in the substrate of the phased antenna array (e.g., the phased antenna array of FIG. 8), the radiation pattern envelope widens from curve 200 to curve 202. In other words, the presence of surface-wave-mitigation structures may increase the antenna signal coverage area of phased antenna array 60. These curves are merely illustrative. The radiation pattern of phased antenna arrays with or without surface-wave-mitigation structures may have any other desired shapes. The radiation pattern shown in FIG. 13 illustrates a two-dimensional view of radiation patterns. In general, radiation patterns generated by antenna arrays are three-dimensional. As an example, the radiation patterns shown by curves 200 and 202 may be rotationally symmetrical about the z-axis in a three-dimensional representation of FIG. 13.

The foregoing is merely illustrative and various modifications can be made to the described embodiments. The foregoing embodiments may be implemented individually or in any combination.

What is claimed is:

1. An electronic device, comprising:

a phased antenna array including a plurality of antenna elements on a dielectric substrate, wherein the dielectric substrate comprises surface-wave-mitigating recesses, each surface-wave-mitigating recess is interposed between two respective antenna elements, and each surface-wave-mitigating recess has a width that is equal to a distance between the two respective antenna elements; and transceiver circuitry coupled to the phased antenna array and configured to convey wireless signals at a frequency greater than 10 GHz using the phased antenna array.

2. The electronic device defined in claim 1, further comprising:

a grounding layer coupled to the dielectric substrate.

3. The electronic device defined in claim 2, further comprising:

a plurality of transmission line structures, wherein each transmission line structure of the plurality of transmission line structures is coupled to a respective antenna element of the plurality of antenna elements through the dielectric substrate.

4. The electronic device defined in claim 3, wherein each transmission line structure of the plurality of transmission line structures is coupled to the grounding layer.

5. The electronic device defined in claim 4, further comprising:

a dielectric cover having a curved inner surface formed over the plurality of antenna elements, wherein the grounding layer is curved.

6. The electronic device defined in claim 1, wherein the dielectric substrate has portions having a first thickness under the plurality of antenna elements and portions having a second thickness that is less than the first thickness under the surface-wave-mitigating recesses.

7. An electronic device, comprising:

a dielectric substrate; and an array of antenna resonating elements arranged in rows and columns on the dielectric substrate, wherein the dielectric substrate is patterned to define a continuous recess having a plurality of horizontal portions and a plurality of vertical portions, each horizontal portion of the continuous recess is interposed between adjacent rows of antenna resonating elements, and each vertical portion of the continuous recess is interposed between adjacent columns of antenna resonating elements.

8. The electronic device defined in claim 7, further comprising:

transceiver circuitry coupled to the array of antenna resonating elements and configured to convey wireless signals at a frequency greater than 10 GHz using the array of antenna resonating elements.

9. The electronic device defined in claim 8, further comprising:

a grounding layer having a planar upper surface, wherein the planar upper surface of the grounding layer is coupled to the dielectric substrate.

10. The electronic device defined in claim 8, wherein each antenna resonating element of the array of antenna resonating elements is surrounded by the continuous recess defined by the dielectric substrate.

11. The electronic device defined in claim 8, further comprising:

a plurality of transmission line structures, wherein each transmission line structure of the plurality of transmission line structures is coupled to a respective antenna resonating element of the array of antenna resonating elements through the dielectric substrate.

12. The electronic device defined in claim 11, wherein each transmission line structure of the plurality of transmission line structures is coupled to the grounding layer.

13. The electronic device defined in claim 7, further comprising:

a dielectric cover having a curved inner surface formed over the array of antenna resonating elements.

14. An electronic device, comprising:

a substrate; an array of antenna resonating elements on the substrate, wherein a first portion of the substrate that is overlapped by the array of antenna resonating elements has a first thickness and a second portion of the substrate that is not overlapped by the array of antenna resonating elements has a second thickness that is less than the first thickness; transceiver circuitry coupled to the array of antenna resonating elements and configured to convey wireless signals at a frequency greater than 10 GHz using the array of antenna resonating elements; a dielectric cover having a curved inner surface formed over the array of antenna resonating elements; and a curved grounding layer coupled to the substrate.

15. The electronic device defined in claim 14, wherein the first portion of the substrate includes a plurality of substrate portions and each substrate portion of the plurality of substrate portions is formed under a respective antenna resonating element of the array of antenna resonating elements.

16. The electronic device defined in claim 15, wherein each substrate portion of the plurality of substrate portions is surrounded by the second portion of the substrate.

17. The electronic device defined in claim 14, further comprising:

a grounding layer coupled to the substrate.

18. The electronic device defined in claim 17, further comprising:

a plurality of transmission line structures, wherein each transmission line structure of the plurality of transmission line structures is coupled to a respective antenna resonating element of the plurality of antenna resonating elements through the substrate.

19. The electronic device defined in claim 18, wherein each transmission line structure of the plurality of transmission line structures is coupled to the grounding layer.

20. The electronic device defined in claim 7, further comprising:

a dielectric cover having a curved inner surface formed over the array of antenna resonating elements.

* * * * *